United States Patent [19]

Bianchi

[11] 4,048,817

[45] Sept. 20, 1977

[54] KNITTING MACHINE CAM

[75] Inventor: Massimo Bianchi, Florence, Italy

[73] Assignee: Macchine Tessili Circolari MATEC S.p.A., Rome, Italy

[21] Appl. No.: 728,024

[22] Filed: Sept. 30, 1976

[30] Foreign Application Priority Data

Oct. 6, 1975 Italy ..... 9575/75

[51] Int. Cl.[2] ..... D04B 15/32

[52] U.S. Cl. ..... 66/57; 66/54

[58] Field of Search ..... 66/57, 78, 54

[56] References Cited

U.S. PATENT DOCUMENTS

| | | | |
|---|---|---|---|
| 1,220,918 | 3/1917 | Wilcomb | 66/57 X |
| 2,823,529 | 2/1958 | St.Pienne et al. | 66/57 X |
| 3,572,056 | 3/1971 | Radin | 66/57 |
| 3,613,400 | 10/1971 | Havranek et al. | 66/57 |
| 3,882,694 | 5/1975 | Stepanek et al. | 66/57 X |

FOREIGN PATENT DOCUMENTS

| | | | |
|---|---|---|---|
| 1,585,302 | 4/1970 | Germany | 66/57 |
| 1,230,084 | 4/1971 | United Kingdom | 66/57 |
| 642,374 | 8/1950 | United Kingdom | 66/57 |

*Primary Examiner*—Mervin Stein
*Assistant Examiner*—Andrew M. Falik

[57] ABSTRACT

A knitting machine has a lowering cam which acts on the butts of the needles to lower the needles in an active stroke. A stop cam associated with the lowering cam acts on the butts to decelerate the needles at the end of the stroke. The relative positions of the lowering cam and the stop cam can be adjusted in two mutually transverse directions to ensure smooth engagement of the butts with the stop cam.

2 Claims, 2 Drawing Figures

KNITTING MACHINE CAM

BACKGROUND OF THE INVENTION

1. Field of the Invention

The present invention relates to knitting machines.

2. Description of the Prior Art

In circular knitting machines and other types of knitting machines, there is provided for each yarn feed, a lowering cam which acts on the butts of the needles to lower them in the active or stitch-forming stroke. There is associated with the lowering cam, which is sometimes termed the "drawdown" or "knocking-over" cam, a stop or counter-cam which faces the lowermost part of the lowering cam and which is spaced therefrom by a distance corresponding to the length of the butts in the direction of reciprocating movement of the needles.

With the increase of the speed of movement of the needles with respect to the cams, which occurs in modern machines for achieving higher production rates, serious problems arise owing to the high speed variations of the needles, operated by the above indicated cams, since the extension of the cam profiles is restricted owing to the available space in the machine and to the necessity of receiving selected needles which reach the cams at a relatively low level. Particular difficulties are encountered in the relatively sudden deceleration which the needles receive at the end of their lowering stroke imposed by the lowering cam when the needle butt contacts the stop cam. This deceleration must take place over a distance corresponding to 1 to 1.5 needle pitches, because otherwise the yarn would not be evenly drawn by the needles as too many needles and sinkers would be simultaneously in a retaining or gripping position.

In order to reduce the risk of damage to the needles due to the deceleration at the end of the needle lowering stroke, it has been proposed to provide the stop cam with an arcuate profile arranged to brake the needle gradually at the end of its lowering stroke. Hitherto, this profile of the stop cam has necessitated difficult and expensive machining of the two cams in order to obtain the required accuracy not only of the gap between the lower part of the lowering cam and the stop cam, but also between the last portion of the active profile of the lowering cam for the lowering of the needle butts and the initial portion of the stop cam profile (which must be parallel to the active profile of the lowering cam of the needle butts) and from which initial portion the aforesaid arcuate profile extends. On the other hand, it is necessary that the needle butt grazes the initial portion of the stop cam profile such that the arcuate profile of the stop cam effects deceleration of the needle according to a predetermined function or relationship.

SUMMARY OF THE INVENTION

According to the present invention, there is provided in a knitting machine, a lowering cam engageable with the butts of the needles to lower the needles along a predetermined lowering path, a stop cam engageable with the butts of the needles to effect progressive deceleration of the needles, said stop cam having means defining a first profile parallel with said lowering path, means defining a second profile corresponding to the maximum lowered position of the needles, and means defining a concave connecting profile between the first and second profiles, means for adjusting the position of one of said cams relative to the other of said cams in the direction of reciprocating movement of the needles, and means for adjusting the position of the other of said cams relative to the said one of said cams in a direction transverse to the first direction so as to ensure that the butt engages the stop cam tangentially to the connecting profile.

Further according to the invention there is provided in a knitting machine, a first cam engageable with the butts of the needles to move the needles longitudinally in a stitch-forming stroke, a stop cam engageable with the butts of the needles to decelerate smoothly the needles at the end of the movement imposed by the first cam, means for adjusting the position of the first cam relative to the stop cam in a first direction, and means for adjusting the position of the stop cam relative to the first cam in a second direction inclined to the first direction.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
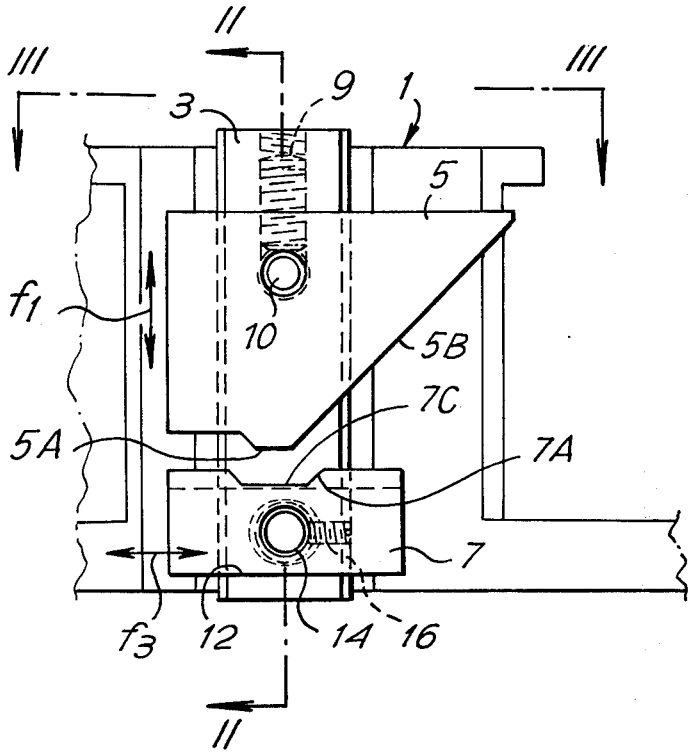
FIG. 1 is a front elevation of a cam support structure and associated cams, of a knitting machine in accordance with the invention.
Figure 2:
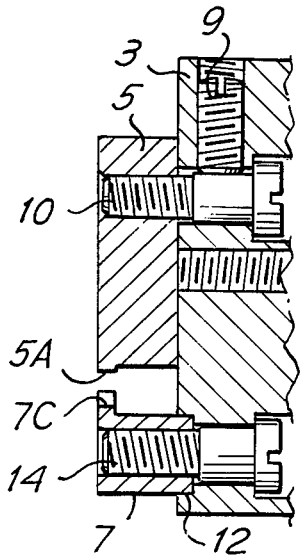
FIG. 2 is a section taken on line II—II of FIG. 1.
Figure 3:
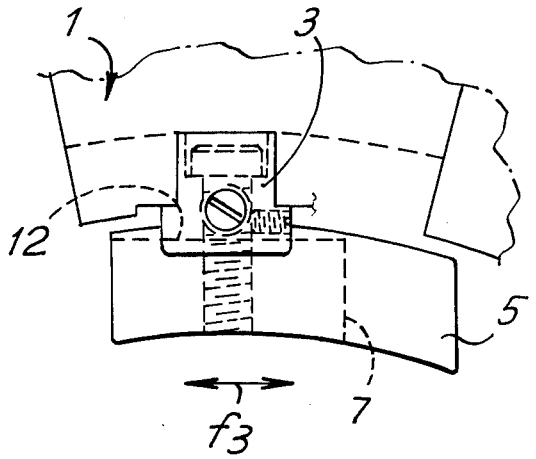
FIG. 3 is a plan view looking along line III—III of FIG. 1.

As shown in the accompanying drawings, a cam support structure 1 has for each yarn feed and at a position at which the needles are to be lowered for the formation of loops, a sliding seat parallel to the direction of movement of the needles as indicated by the double arrow $f_1$. The seat receives a slide 3 arranged to carry a lowering cam 5 and a stop cam 7. The slide 3 is adjustable in the seat by screw means or the like in order to adjust the stitch loop length, with this adjustment, there is obtained simultaneous movement of the cams 5 and 7 as a unit. The cam 5 is adjustably mounted on the slide 3 for movement relative to the slide 3 in the direction of arrow $f_1$. Adjustment of the cam 5 on the slide 3 is obtained by means of a screw or pin 9 carried by the slide 3 and which forms an adjustable shoulder which is engaged by a clamping screw 10 of the cam 5. The screw 10 is accommodated in an aperture wider than the diameter of the screw 10 and passing through the slide 3. This arrangement permits the distance between the lower apex of the cam 5 and the cam 7 to be adjusted.

Figure 4:
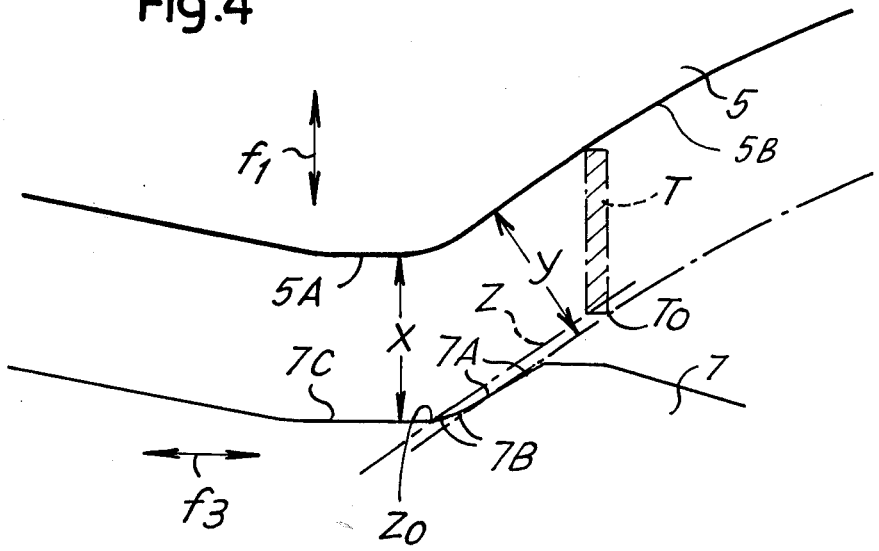
FIG. 4 is a developed schematic view showing the operation of the cams.

The cam 7 is provided with an initial profile 7A (see especially FIG. 4) and an arcuate connecting profile 7B between this initial profile 7A and a profile 7C arranged beneath the lower apex or maximum lowering zone 5A of the cam 5 and extending parallel thereto. The adjustment obtained by means of the screws 9 and 10 as described above allows the desired gap X to be provided between the profiles 5A and 7C. The arcuate connecting profile 7B serves to decelerate the butt T of a needle which is lowered along an active profile 5B of the cam 5, so as to obtain a desired rate of deceleration at the end of the needle lowering stroke. This action of the arcuate profile 7B however involves the necessity of adjusting to a very high degree of accuracy, the relative position of the cams 5 and 7 so that gap Y between the profiles 5B and 7A corresponds exactly to the dimensions of the butt T. The corner T of the butt T farthest from the profile 5B must graze the profile 7A so that the corner $T_O$ engages smoothly the profile 7B which decelerates the butt. If the corner $T_O$ moves along a path such that indicated by Z in FIG. 4 which is only slightly spaced from the profile 7A, there would be a sudden impact at the point $Z_O$ between the corner $T_O$ and the profile 7B and thus a sudden deceleration of the butt T and of the needle which may cause breakage or other damage to the needle. For this reason, the gap Y must be set with a very high degree of accuracy.

In order to avoid the above stated disadvantage, and in order to accurately adjust the gap Y with inexpensive and simple means, there is provided in the slide 3, a guide 12 perpendicular to the direction of the arrow $f_1$ and in which the cam 7 is slidable in the direction of the arrow $f_3$. The cam 7 is locked in the guide 12 by means of a screw 14 similar to the screw 10 and cooperating with a screw or pin 16, with an arrangement similar to that already described for the adjustment of the cam 5.

With this arrangement, it is possible to obtain, in a simple manner, the adjustment of the position of the cam 7 with respect to the cam 5 in the direction of the arrow $f_3$, without necessitating high machining costs and a high machining accuracy.

It should be noted that with the adjustment of the cam 7 with respect to the cam 5 in the direction of the arrow $f_3$, the gap X is not altered between the two cams in correspondence of the lower apex of the cam 5. Therefore there is obtained with the adjustment of the cam 7, smooth deceleration of the butt by means of the arcuate profile 7B without any sudden impacts of the corner $T_O$ which at high speeds would be liable to cause breakage of the needle.

In an alternative arrangement (not shown), the cam 5 may be adjustable in the direction of the arrow $f_3$ and the cam 7 in the direction of the arrow $f_1$. In other alternative arrangements the cams may be adjustable relative to each other in directions different to those indicated by the arrows $f_1$ and $f_3$ and inclined to each other, in such a manner as to obtain final adjustment which does not alter the previous adjustment or adjustments.

The invention is applicable to circular knitting machines for knitting hosiery, and to other types of knitting machines.

What is claimed is:

1. In a knitting machine, a lowering cam engageable with butts of needles to lower the needles along a predetermined lowering path, a stop cam engageable with the butts of the needles to effect progressive deceleration of the needles, said stop cam having means defining a first profile parallel with said lowering path, means defining a second profile corresponding to the maximum lowered position of the needles, and means defining a concave connecting profile between the first and second profiles, means for adjusting the position of one of said cams relative to the other of said cams in the direction of reciprocating movement of the needles, and means for adjusting the position of the other of said cams relative to the said one of said cams in a direction transverse to the first direction so as to ensure that the butt engages the stop cam tangentially to the connecting profile, slide means carrying said cams, and being movable to adjust the loop length of the stitches, said slide means comprising means defining two mutually transverse guides each mounting a respective one of the cams, screw-clamping means for locking each of the cams in a selected position along its associated guide, and respective stop screw means associated with each of the guides and defining said selected position of the cam, the axis of each screw means lying longitudinally of its associated guide.

2. A knitting machine according to claim 1, wherein the lowering cam is movable on the slide in the direction of reciprocating movement of the needles and the stop cam is movable on the slide in a direction transverse to the direction of reciprocating movement of the needles.

* * * * *